United States Patent [19]

Burout, III

[11] Patent Number: 4,949,457

[45] Date of Patent: Aug. 21, 1990

[54] SOFT RESILIENT RAZOR HANDLE

[75] Inventor: Charles J. Burout, III, Oxford, Conn.

[73] Assignee: Warner-Lambert Company, Morris Plains, N.J.

[21] Appl. No.: 227,930

[22] Filed: Aug. 3, 1988

[51] Int. Cl.[5] ..... B26B 21/14

[52] U.S. Cl. ..... 30/85; 16/110 R; 16/DIG. 12; 16/DIG. 19

[58] Field of Search ..... 30/85–89, 30/32; 16/110 R, 116 R, DIG. 12, DIG. 19, DIG. 24

[56] References Cited

U.S. PATENT DOCUMENTS 2,235,841 3/1941 Monnet ..... 30/85

2,651,878 9/1983 Webbeking ..... 16/110 R 3,716,433 2/1973 Plummer ..... 16/110 R

*Primary Examiner*—Douglas D. Watts

*Attorney, Agent, or Firm*—Daniel A. Scola, Jr.; Howard Olevsky

[57] ABSTRACT

According to this invention a composite razor handle having a rigid inner core of thermoplastic material and a moldable flexible resilient covering layer is provided. This flexible convering layer because of its flexibility, compressibility and initial deformability provides a comfortable secure surface for the razor user. The handle of this invention, due to its bicomponent nature, provides a limit for compressibility as well as the compressive resilience desirable by many users.

8 Claims, 2 Drawing Sheets

SOFT RESILIENT RAZOR HANDLE

BACKGROUND OF THE INVENTION

Wet shaving razors of the disposable and cartridge types are conventionally made of an injection molded plastic material such as polystyrene. The handle portion of the razor is generally roughened or textured in some manner to provide a gripping surface for the user. This is particularly desirable because of the slipperiness imparted to the handle during the act of shaving resulting from the contact of the handle with soap and water during rinsing.

Previously, the Schick Injector razor was sold having a plastic textured handle which had a soft textured surface resembling leather. Such a handle promoted user comfort in that it provided enhanced gripping capabilities. The handle, however was essentially incompressible.

Throughout the past several years, handles having a hollow core and multiple components have been used wherein the hollow core of the handle serves as a reservoir for a shaving cream. An example of such a handle is disclosed in U.S. Pat. No. 3,703,765 issued to Perez. This patent describes a two component handle wherein the wider of the two components telescopes upward to serve as a dispensing means for shaving cream located in the inner portion of the handle. British Patent No. 1,593,979 discloses a razor with a deformable head in which blades are embedded in a resilient plastic material.

SUMMARY OF THE INVENTION

According to this invention a composite razor handle having a rigid inner core of thermoplastic material and a moldable flexible resilient covering layer is provided. This flexible covering layer because of its flexibility, compressibility and initial deformability provides a comfortable secure surface for the razor user.

The handle of this invention, due to its bicomponent nature, provides a limit for compressibility as well as the compressive resilience desired by many users.

BRIEF DESCRIPTION OF THE DRAWINGS

The invention will be more readily understood by reference to the drawings in which.

DETAILED DESCRIPTION OF THE INVENTION

Figure 1:
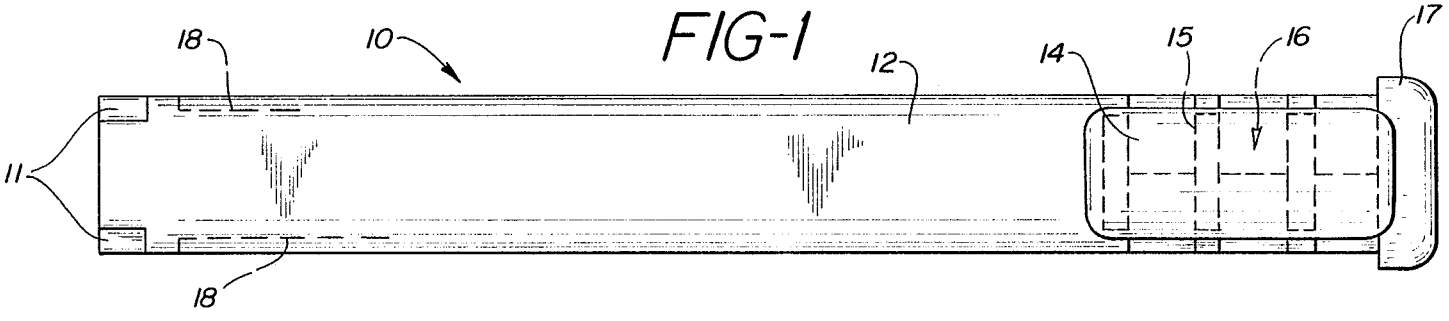
FIG. 1 is a plan view.
Figure 2:
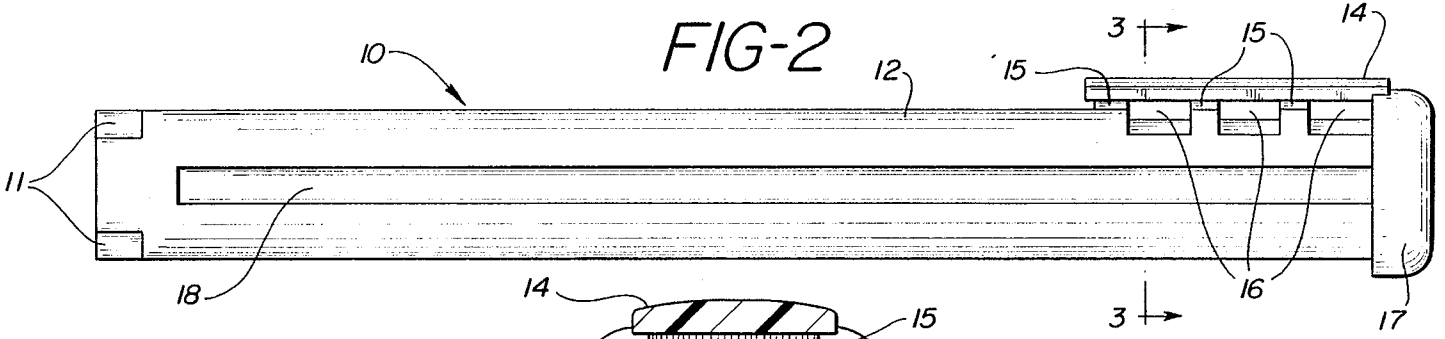
FIG. 2 is a side view.
Figure 3:
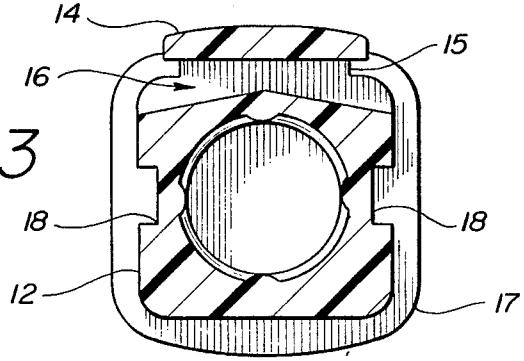
FIG. 3 is a cross sectional view taken along the lines of 3—3 of FIG. 2 of the razor core of this invention.

The rigid thermoplastic core 10 of the handle of this invention, as can be seen by reference to FIGS. 1, 2 and 3 has an elongate portion 12 and a raised area 14. Raised area 14 is positioned at the bottom portion of the razor handle 17 and overlies recess 16 inset into the elongate portion 12 under raised portion 14. The handle core 10 is further characterized by a pair of longitudinally extending elongate slots 18. FIG. 2 shows one side of an essentially symmetrical razor handle core. Notches 11 are spaced around the top of the handle.

It should be noted that the handle as defined for purposes of this invention is the gripping portion of either a disposable razor or a cartridge razor. The method of attachment of the cartridge of a cartridge razor or the head portion of a disposable razor are well known in the art and not part of this invention.

Figure 4:
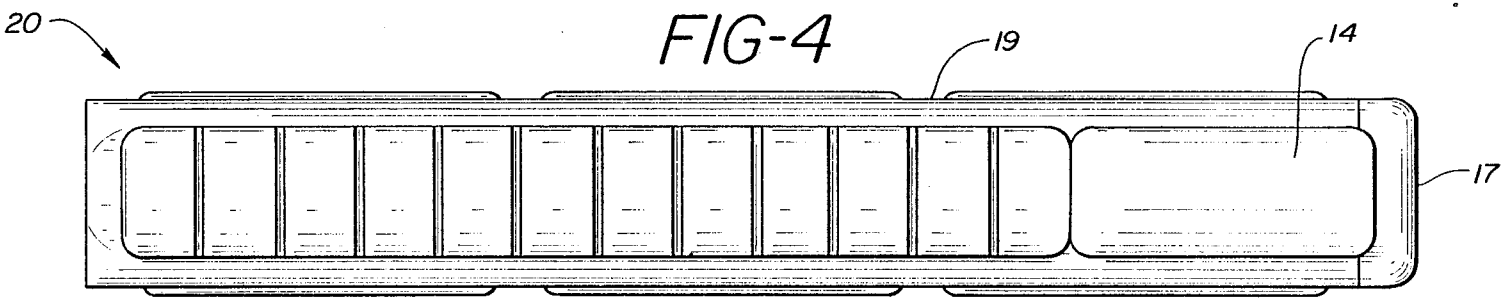
FIG. 4 is a plan view of the complete handle.
Figure 5:
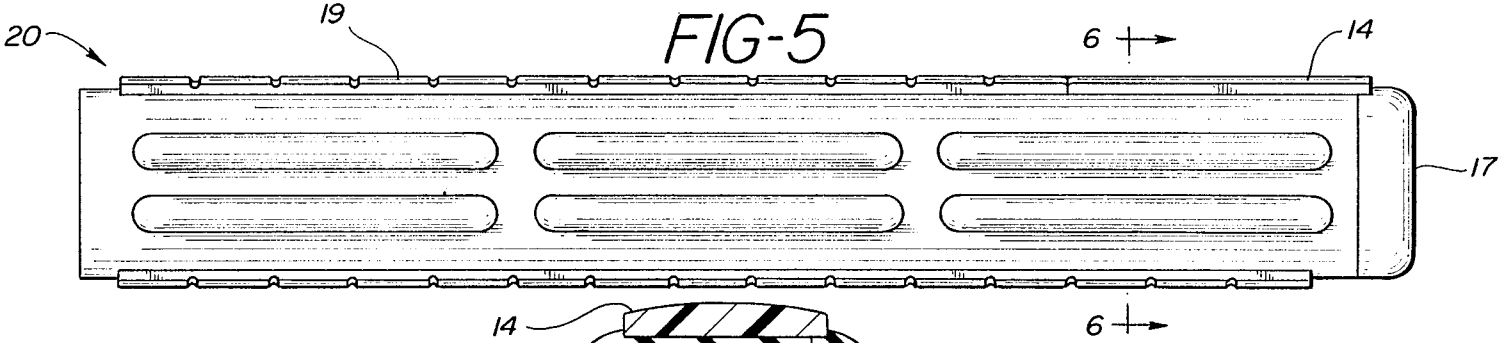
FIG. 5 is a side view of the handle.
Figure 6:
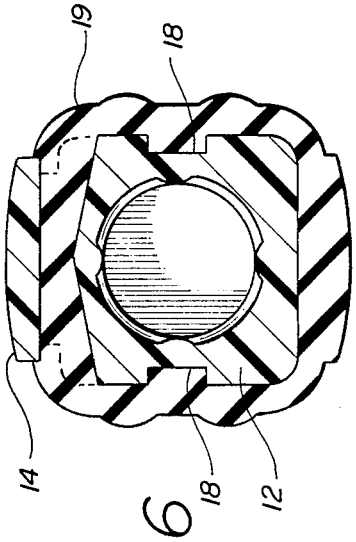
FIG. 6 is a cross sectional view taken along the lines 6—6 of FIG. 5 of the razor handle of this invention.

The assembled razor handle containing both portions is shown at FIGS. 4, 5 and 6. In this instance the completed handle 20 has a soft resilient portion 19 which, as can be seen by FIG. 4 extends axially from but does not cover raised area 14 of handle core 10. By referring to FIG. 6 it will be seen that the resilient portion 19 flows under the raised planar surface 14 through recessed areas 16 to provide a means of anchoring the covering portion at the base of the handle.

To prevent rotational slippage of the soft covering layer, the layer is also positioned in the elongate recesses 18 as shown in FIG. 6. The notches 11 provide anchoring means for the handle cover to prevent it peeling back from the top of the handle.

Both the core 10 and the handle 19 are made of moldable material. These materials must be compatible to the extent that the underlying thermoplastic core material maintains its structural integrity while the moldable covering layer is formed about it. In other words the choice of the resilient covering material determines the particular thermoplastic core material because of its needs for compatible operating conditions during molding. A suitable, and presently preferred combination employs an acrylonitrile, butabiene styrene (ABS) copolymer such as Cyrolac DFA R-4500 manufactured by Borg Warner of Chicago, Ill.

The choice is dictated by the currently preferred covering layer material which is a thermoplastic rubber such as Santoprene, 201-64 sold by Monsanto Inc., St. Louis, Mo.

A currently preferred method of manufacture of the handles is by an insert molding process wherein the cores are molded of the ABS polymer, ejected and placed into a second mold wherein the moldable thermoplastic rubber encompasses the core as shown in FIGS. 4–6.

An alternative method of manufacture is to complete the injection molding in a two step process in a single mold. In either instance, after the ABS core is formed it provides part of the male mold member.

In order for the handle to perform satisfactorily according to this invention, it is desirable that the outer layer be both compressible and resilient so that after repeated compressions the handle loses no more than 20% of its circumferential area of the point of the compressions and preferably less than about 5%.

It is also preferred that the handle covering be between 0.025 and 1.5 inches in thickness thus allowing for ample compression resilience and security of grip by the user. The covering layer can be further defined as having a durometer value of between 55 Shore A and 50 Shore B hardness and most particularly between 55 and 80 Shore A.

The handle produced according to this invention is soft, esthetically pleasing resilient and easy to use during the wet shaving operation.

I claim:

1. A composite razor handle comprising in combination:

(a) a rigid inner core of thermoplastic material, said core having at least one elongate indentation extending substantially along its length;

(b) a moldable compressible resilient covering layer, said layer having durometer values between 55 Shore A and 50 Shore D hardness.

2. The razor handle of claim 1 wherein the core is made of an ABS copolymer.

3. The razor handle of claim 1 wherein the covering layer is made from thermoplastic rubber.

4. The razor handle of claim 1 wherein compressive set is less than about 22%.

5. The razor handle of claim 1 wherein compressive set is less than about 5%.

6. The razor handle core of claims 2, 3, 4 or 5 wherein said core is elongate with a top portion, a base portion and at least one side surface wherein said base has a raised area covering at least a portion of said at least one side surface said raised area and said side surface separated by at least one flow through passage.

7. The razor handle core of claims 1, 2, 3, 4 or 5 wherein said core has at least one radial indentation at said top.

8. A composite razor handle comprising in combination:

(a) a rigid inner core of thermoplastic material wherein said core is elongate with a top portion, a base portion and at least one side surface wherein said base has a raised area covering at least a portion of said at least one side surface said raised area and said side surface separated by at least one flow through passage;

(b) a moldable compressible resilient covering layer, said layer having durometer values between 55 Shore A and 50 Shore D hardness.

* * * * *